US005758723A

United States Patent [19]

Saucier et al.

[11] Patent Number: 5,758,723

[45] Date of Patent: Jun. 2, 1998

[54] FLUID PRESSURE DEACTIVATED THRU-TUBING CENTRALIZER

[75] Inventors: David Dwayne Saucier; Britt O. Braddick, both of Houston, Tex.

[73] Assignee: TIW Corporation, Houston, Tex.

[21] Appl. No.: 658,504

[22] Filed: Jun. 5, 1996

[51] Int. Cl.[6] ..... E21B 23/08

[52] U.S. Cl. ..... 166/55.8; 166/241.6; 175/325.3

[58] Field of Search ..... 166/41.1, 55.8, 166/241.6; 175/76, 269, 320, 325.3

[56] References Cited

U.S. PATENT DOCUMENTS

| | | | |
|---|---|---|---|
| 2,891,769 | 6/1959 | Page, Sr. et al. . | |
| 3,098,534 | 7/1963 | Carr et al. . | |
| 3,298,449 | 1/1967 | Bachman et al. . | |
| 3,370,657 | 2/1968 | Antle . | |
| 4,185,704 | 1/1980 | Nixon, Jr. . | |
| 4,270,619 | 6/1981 | Base . | |
| 4,388,974 | 6/1983 | Jones, Jr. et al. . | |
| 4,394,881 | 7/1983 | Shirley . | |
| 4,407,377 | 10/1983 | Russell . | |
| 4,471,843 | 9/1984 | Jones, Jr. et al. . | |
| 4,776,394 | 10/1988 | Lynde et al. | 166/55.8 |
| 4,842,083 | 6/1989 | Raney . | |
| 4,854,403 | 8/1989 | Ostertag et al. . | |

FOREIGN PATENT DOCUMENTS 541012 2/1973 U.S.S.R. .

WO 92/09783 6/1992 WIPO .

OTHER PUBLICATIONS

Tri–State Oil Tools advertisement, Cover Page, pp. 20 and 27.

*Primary Examiner*—Roger J. Schoeppel
*Attorney, Agent, or Firm*—Browning Bushman

[57] ABSTRACT

A thru-tubing centralizer 10, 102 positioned along a tubular T after passing through a small diameter tubing string TS centralizes the tubular within a large diameter casing string CS. The centralizer includes a body 12, 112 having a throughbore 14 for transmitting fluid through the centralizer, such that a drill motor M and rotatable bit B may be suspended from the tubular T below the centralizer. The centralizer includes a piston 20, 136 and arm support sleeve 30, 130 each movable axially between a set position and a released position in response to increased fluid pressure in the throughbore of the centralizer body. The compression spring 40, 156 biases an arm support sleeve to a set position, such that a plurality of circumferentially spaced upper arms 50, 116 and a corresponding plurality of circumferentially spaced lower arms 60, 126 are each inclined with respect to the centralizer body to maintain the centralizer in a set position for engaging the casing string. Increased pressure within the centralizer body moves the piston and the arm support sleeve to the released position, such that the upper and lower arms are retracted so that the centralizer may be retrieved to the surface through the tubing string.

24 Claims, 4 Drawing Sheets

FLUID PRESSURE DEACTIVATED THRU-TUBING CENTRALIZER

FIELD OF THE INVENTION

The present invention relates to a downhole centralizer of the type commonly used to desirably position the axis of a tubular within a larger diameter casing string. More particularly, this invention relates to a thru-tubing centralizer which may be passed through a small diameter tubular string, and may then be set within a large diameter casing string for engaging the inner wall of the casing string to centralize the tubular. After being set in the casing string, the centralizer may be released to a retracted position in response to fluid pressure, and may thereafter be returned to the surface through the small diameter tubing string.

BACKGROUND OF THE INVENTION

Various downhole hydrocarbon recovery operations are more reliably performed, or may only be performed, when a tubular (or a tool positioned along a tubular) is desirably positioned radially within a casing string. For example, a downhole tool may be set within the casing string with the axis of the tool aligned with the casing string. Another tool at a lower end of the tubular may need to be interconnected with the set tool, and this connection requires that the tubular and thus the tool suspended therefrom be properly centered within the casing string. In other cases, a tubular may be run in a highly inclined or horizontal well, so that gravity tends to position the tubular for engaging a low side of the casing string. By centering the tubular within the casing string, wear between the tubular and the casing string may be reduced. In still with operations, it is necessary or desirably to intentionally offset the axis of a tubular within a casing string. When dual tubing strings are run in a well, for example, it may be necessary to align an upper tubular with one of the dual lower tubulars by offsetting the upper tubular within the casing string. The desired radial offset and the proper circumferential orientation of the upper tubular within the casing string will thus enable thc; axis of the upper tubular to be aligned with the axis of the desired one of the lower dual tubing strings. A downhole centralizer thus typically aligns the axis of a tubular along which it is positioned with the axis of a casing string, but may be used to desirably position the axis of the tubular at an offset position within the larger diameter casing string.

Numerous types of downhole centralizers have been devised. U.S. Pat. Nos. 2,891,769, 3,298,449,4,185,704,4,270,619,4,388,974,4,394,881,4,407,377, 4,471,843, 4,842,083, and 4,854,403 disclose downhole tools with pads, blades, or buttons that move radially outward to either centralize or offset a tubular within a well. Other exemplary tools are disclosed in PCT Publication No. WO 92/09783 and Russian Patent No. 541012. Most of these tools are very complex and are thus expensive to manufacture and difficult to maintain. Because many of these tools are complex, they are also not highly reliable and their operation requires a large amount of training and experience.

A hydraulic stabilizer manufactured by Tri-State Oil Tools was developed to be run above cutters. The stabilizer centralizes a work string when cutting. Stabilizer arms include pads for engaging the I.D. of a casing. The stabilizer mandrel rotates with the work string while heavy duty bearings allow the arms and pads to remain stationary. The stabilizer arms expand outward in response to increased hydraulic pressure. When pump pressure is stopped, the stabilizer collapses.

Particular problems are encountered when it is necessary to centralize a tubular within a casing string below a small diameter tubing string. A centralizer positioned along the tubular must pass through the small diameter tubing string and be set at the desired axial position within the casing string below a lower end of the tubing string. To first position the centralizer at its desired axial position within the casing string, the centralizer must be small enough to pass through the tubing string, and an expanded position of the centralizer must be large e nough to engage the inner wall of the large diameter casing string. It is generally preferably that, after the centralizing operation is complete, the centralizer again be moved to a retracted position so that it may be returned to the surface through the small diameter tubing string.

In many applications, the throughbore in the centralizer body desirably does not substantially restrict the flow of fluid through the tubular. Accordingly, there is very little wall thickness between the diameter of the centralizer body throughbore and the outer surface of the centralizer. This problem is particularly of concern in thru-tubing applications, since flow through the centralizer is desirably not significantly restricted. Moreover, the centralizer must be sized when retracted for passing through the small diameter tubing string, then the centralizer must be set for centering the tubular in a much larger diameter casing string.

Applications involving thru-tubing window milling and drilling of lateral wellbores require that tools have a sufficiently small diameter to be conveyed (usually by coiled tubing) through a small inside diameter well tubing string and then operated within a larger inside diameter casing string situated below the tubing string. In situations in which lateral wellbores are drilled from the casing below a tubing string set within the casing, and in cases in which a whipstock or similar diversion tool is employed to mill a window in a highly deviated casing for drilling the lateral, the mill ramp or trough of the whipstock or other diversion tool is rotated to face the desired number of degrees to either the right or left of the high side of the casing. Window mill and formation drill bits may be unable, however, to engage the whipstock or diversion tool ramp or trough to direct mills and bits into and through the casing window and then through the lateral borehole at the desired angular orientation with respect to the high side of the lateral unless the mill or bit is centralized to reliably engage the ramp or trough of the whipstock. After engaging the ramp or trough to guide or direct the mills and/or bits into and/or through the casing window and lateral wellbore, it is desirable to avoid interference of the centralizer with the window milling or lateral wellbore drilling operations.

Prior art centralizers thus have significant disadvantages which have limited there acceptance in the industry. Many centralizers are expensive and difficult to operate, and cannot be utilized in thru-tubing applications. Other centralizers require axial forces to be transmitted through the tubular to set or unset the centralizer. Since the tubular on which the centralizer is positioned may be a coiled tubing string, these mechanically set centralizers often cannot be reliably used in many coiled tubing operations.

An improved centralizer is required in order to benefit from the significant advantages of thru-tubing applications which allow operations to be performed downhole below a small diameter tubing string and within a larger diameter casing string. The disadvantages of the prior art are overcome by the present invention, and an improved downhole centralizer and an improved method of positioning, setting, and retrieving a downhole centralizer are hereinafter disclosed which have particular utility in thru-tubing operations.

SUMMARY OF THE INVENTION

A suitable embodiment of a fluid pressure deactivated thru-tubing and self-centering centralizer according to the present invention includes a centralizer body having upper and lower threaded ends for positioning along a tubular, such as a coiled tubing string. A drill motor may be positioned below the centralizer for rotating a bit. The bit, drill motor, and centralizer may be lowered through a small diameter tubing string to a desired position in the casing string immediately above a whipstock secured within the casing string. With the centralizer set or activated, the tubing string is further lowered so that the rotating bit engages the whipstock and cuts a window in the casing string. By centralizing the tubular within the casing string, the bit reliably engages the inclined surface of the whipstock to cut the window. Pressurized fluid is passed through the centralizer body and to the drill motor for powering the rotating bit, and during this operation the centralizer is deactivated. After the window is cut in the casing string, the centralizer, drill motor, and bit may be retrieved to the surface through the small diameter tubing string. Thereafter, the centralizer, along with the drill motor and formation bit, may be repositioned in the wellbore for drilling another lateral.

The centralizer body thus includes a throughbore for transmitting fluid through the centralizer. The centralizer includes a piston axially movable in response to fluid pressure within the throughbore from a set position to a released position. An arm support sleeve is also axially movable relative to the centralizer body between a set position and a released position, with movement of the arm support sleeve being controlled by axial movement of the piston. A plurality of circumferentially spaced upper arms are each pivotally connected at an upper end to the centralizer body, and a corresponding plurality of circumferentially spaced lower arms are each pivotally connected at a lower end to the arm support sleeve. The upper end of the lower arms are pivotally connected to a lower end of the upper arms. When the centralizer is in the set position, the lower ends of the upper arms and/or the upper ends of the arms engage the tubing and casing string to automatically centralize the tubular. When fluid pressure is increased to a preselected high valve, the piston and the arm support sleeve move to the released position, and the upper and lower arms retract so that the centralizer may be deactivated.

A compression spring is provided for biasing the arm support sleeve to the set position, thereby maintaining the arms inclined with respect to a central axis of the centralizer body for engaging the casing string. When fluid pressure is increased in the tubular to the preselected high valve, a pin which interconnects the piston to a centralizer body shears, thereby allowing a retaining sleeve which supports the compression spring to move to a released or decompressed position. By moving the retaining sleeve to the released position, the biasing force of the compression spring on the arm support sleeve is removed or at least substantially reduced. To ensure the return of the arms to a retracted position once the piston moves to the released position, a retract spring is provided for acting on at least one of the plurality of upper arms and lower arms. In the unlikely event that the piston cannot be moved to its released position or that the released piston does not result in the return of the arms to their released position, the upper arms, which preferably are axially longer than the shorter arms, may engage the lower end of the tubing string so that an upward force on the tubular will inherently retract the arms. Accordingly, the centralizer may still be returned to the surface through the tubing string.

It is an object of the present invention to provide a relatively simple and highly reliable centralizer for positioning along a tubular such that the tubular and centralizer may be lowered through a small diameter tubing string into a selected axial position within a large diameter casing string below a lower end of the tubing string, with the centralizer serving to radially position the axis of the tubular with respect to the axis of the casing string. A related object of the invention is to ensure that, after the centralizing operation is complete, the centralizer may be returned to the surface through the small diameter tubing string.

Another object of the present invention is to provide a centralizer which may expand dramatically from a retracted position to a set position in response to no or low fluid pressure while maintaining a relatively large diameter throughbore through the centralizer body for passing fluids through the centralizer when in either the retracted or the set position. In response to high fluid pressure, the centralizer retracts to substantially its run-in position.

It is a feature of the present invention that the centralizer is responsive to fluid pressure to cause the centralizer to move from a set position wherein the centralizer engages a large diameter casing string to a retracted position wherein the centralizer may be returned to the surface through a small diameter tubing string. It is a further feature of the present invention that increased fluid pressure may be used to axially move a piston within the centralizer body, which then allows a retaining sleeve to move axially to at least substantially remove the biasing force of a compression spring which normally maintains the upper and lower arms in the set position. Increased fluid pressure may be used to shear a pin which interconnects the piston with the centralizer body, and the increased fluid pressure need not be used to directly overcome the biasing force of the compression spring.

It is another feature of the invention that the centralizer may be used to centralize a drill bit within a casing string, with the drill bit being rotated by a downhole motor which is powered by transmitting fluid through a tubular and the centralizer. The centralized bit may reliably engage a whipstock to cut a window in the casing string, then the centralizer, drill motor, and bit returned to the surface through the small diameter tubing string.

Yet another feature of the invention is that the expandable centralizer arms are rotationally secured to the centralizer body. The arms do not rotate relative to the centralizer body, although the centralizer body need not rotate when the arms are moved to the expanded position.

A significant advantage of the present invention is that the centralizer is relatively simple, and has few moving parts. The centralizer is thus comparatively inexpensive to manufacture and may be easily serviced and repaired. A related advantage of the present invention is that the centralizer operations are relatively simple, and the centralizer may be reliably utilized with little training and experience.

These and further objects, features, and advantages of the present invention will become apparent from the following detailed description, wherein reference is made to the figures in the accompanying drawing.

BRIEF DESCRIPTION OF THE DRAWINGS

FIGS. 5, 6 and 7 are half sectional views of an alternate embodiment of a centralizer according to this invention capable of being repeatedly activated to expand in response to no or low fluid pressure and repeatedly deactivated to retract in response to normal or high fluid pressure.

DETAILED DESCRIPTION OF THE PREFERRED EMBODIMENTS

Figure 1:
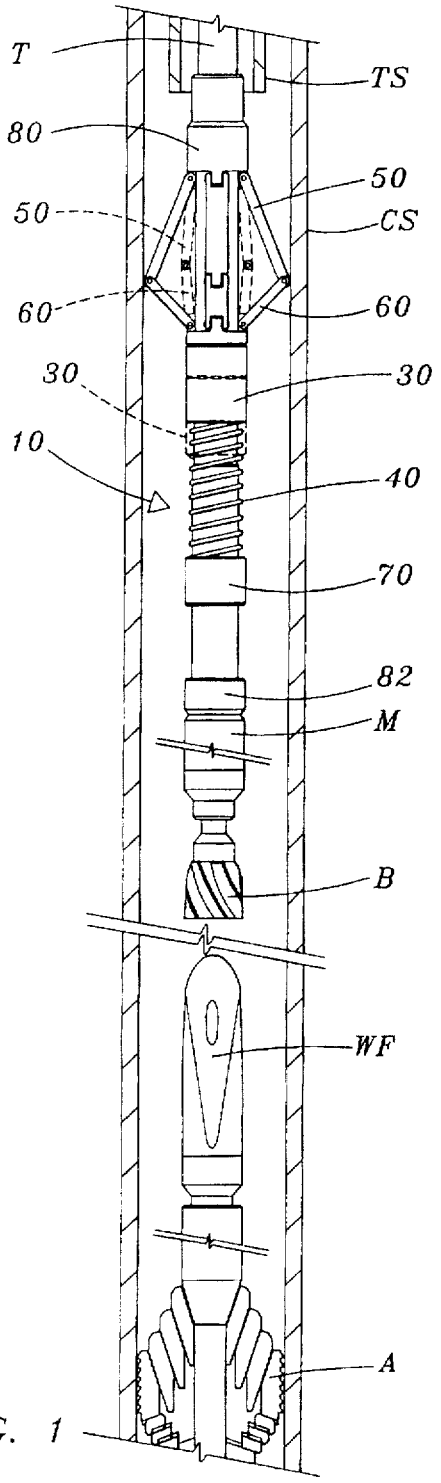
FIG. 1 is a simplified pictorial view illustrating a centralizer, a drill motor, and a bit suspended from a tubular in a casing string after being passed through a small diameter tubing string. The bit is positioned for engaging the ramp surface of a whipstock secured within a casing string, so that the bit will begin cutting a window in the casing string. Although shown vertically, those skilled in the art will appreciate that in an inclined or horizontal borehole, the whipstock is depicted in a manner corresponding to a view from the high side of the wellbore.
Figure 2:
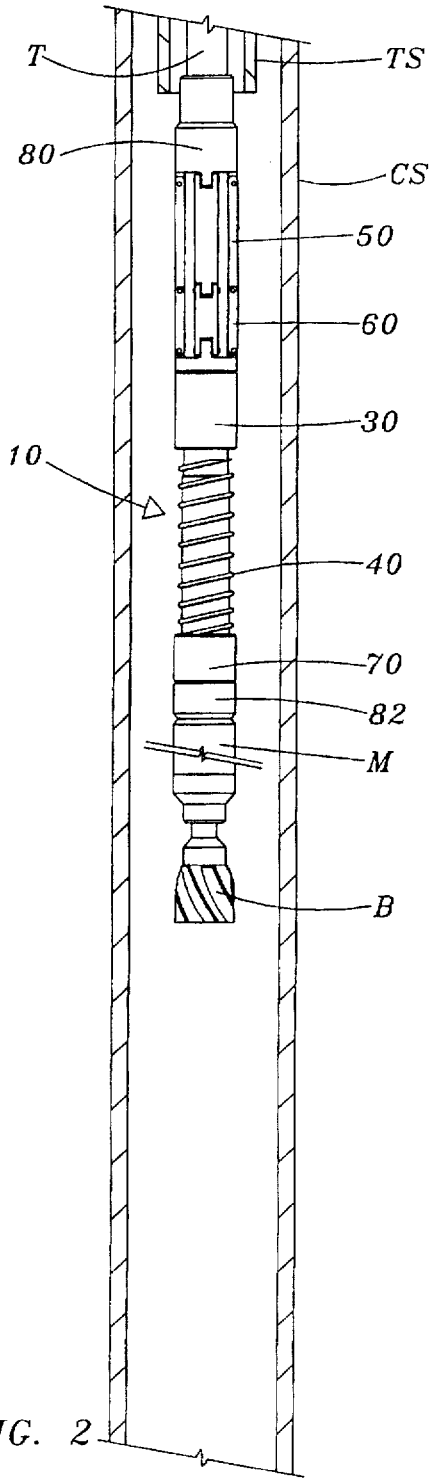
FIG. 2 is a simplified pictorial view of the centralizer, the drill motor, and the bit as shown in FIG. 1, with the centralizer retracted so that the tools suspended from the tubular may be used to mill the window and/or drill the lateral wellbore without interference from the centralizer.

FIGS. 1 and 2 illustrate a suitable application for a centralizer according to the present invention. The centralizer 10 is suspended in a well from a tubular T. While the tubular T may be any type of small diameter oilfield tubular, the centralizer of the present invention is particularly well suited for coiled tubing applications, and accordingly in the following description the tubular T is described as a coiled tubing of the type commonly used in thru-tubing applications. The centralizer 10 is thus suspended from the coiled tubing T, and a downhole drill motor M is suspended from the centralizer. The drill motor M is of the type which conventionally receives pressurized fluid transmitted to the tubular T and the centralizer 10 to rotate the bit B, which may be a starter bit used to initially cut the portion of a window in the casing string CS. The components which are suspended from tubular T may be lowered from the position as shown in FIG. 1 so that the bit B engages the whipstock W, which is centrally positioned within the casing string CS on a whipstock anchor A. Fluid flow through the tubular T and the centralizer 10 powers the motor M to rotate the bit B, which engages the whipstock face or ramp surface WF of the whipstock W to divert the bit and thus begin cutting a window in the casing string. The whipstock W and the anchor A may also be passed through the tubing string TS and set in the casing string CS, as disclosed in U.S. Pat. No. 5,595,247.

All the components suspended from the tubular T as shown in FIG. 1 first pass through the small diameter tubing string TS and are thus positioned at a desired elevation within the casing string CS. The lower end of the tubular string TS terminates axially above the set whipstock W, and the window cutting operation described herein is performed without incurring the considerable expense of first running the tubing string TS out and then back in the well. In an exemplary application, restrictions within the tubing string TS have a minimum internal diameter of approximately 3.69 inches, while the casing string CS has an internal diameter of approximately 8.53 inches. The terms "tubing string" and "casing string" as used herein are relative terms and may be applied to various types of oilfield tubulars which generally have a small diameter and a large diameter, respectively.

Bit B, motor M, and the centralizer 10 each suspended from the tubular T are thus passed downhole through the small diameter tubing string TS, and are then positioned within the casing string CS at a position immediately above the whipstock W for cutting a window in the casing string CS. It should be understood that there may be a significant axial spacing between the lower end of the tubing string TS and the whipstock W, and that the lower end of the tubular T, the motor M, and the bit B typically could not be centralized in the casing string CS without a centralizer 10. Since the whipstock W may also have passed through the tubing string TS, the width of the ramp surface WF of the whipstock W as shown in FIG. 1 is less than the internal diameter of the tubing string TS. If not centralized within the casing string CS, the bit B may be to the right or to the left of the ramp surface or whipstock face WF as shown in FIG. 1, and thus would not properly engage the whipstock W for cutting the window in the casing string CS at the desired orientation determined by the set whipstock W.

The centralizer 10 of the present invention is well suited for use in highly inclined and horizontal wellbore applications. Those skilled in the art will appreciate the benefits of the present invention for those applications in view of the following detailed description. When used for centralizing a whipstock W in a horizontal wellbore application, the whipstock W as shown in FIG. 1 is depicted in a view taken from the high side of the wellbore. For an application wherein the whipstock is oriented for drilling a hole in the casing at an angle of 30° to the right of top center, the centralizer 10 retains the bit centered in the horizontal wellbore so that it engages the face of the whipstock properly to drill that hole. Without the centralizer, the bit would tend to drop to the bottom of the casing and in that position may not properly engage the whipstock to drill the casing hole at the desired orientation.

The centralizer 10 as shown in solids lines in FIG. 1 is in its set position for centralizing the lower end of the tubular and thus the bit B within the casing string CS. Although only one centralizer is described herein for centralizing the tubular T and thus the bit B with respect to whipstock W, one or more other centralizers each structurally and operationally identical to that described herein may be positioned along the tubular T above the centralizer 10 to assist in alignment of tubular T. By aligning the tubular T, the downhole motor M and the bit B powered by the motor thus become at least generally aligned with the whipstock W which is centralized within the casing string CS.

While the components of the centralizer 10 are discussed in detail below, it should be understood that, when passing through the tubing string TS, arm support sleeve 30 and the upper and lower arms 50 and 60 will be generally as shown in the dashed lines in FIG. 1. When running through the tubing string TS, the arms 50 and 60 will thus be substantially parallel to a central axis of a tubing string TS, thereby lowering the arm support sleeve 30 and further compressing the compression spring 40. Once the centralizer 10 passes below the lowermost end of the tubing string TS, the biasing force of the compression spring 40 pushes the support sleeve 30 upward, thereby pivoting both the upper and lower arms to the solid line position as shown in FIG. 1 so that the angled arms engage the inner surface of the casing string. While any number of pivot arms may be provided in a centralizer according to the present invention, at least three upper and lower pivot arms, and preferably at least four upper and lower pivot arms, are preferably provided at an equal circumferential spacing about the body of the centralizer for engaging the inner surface of the casing string CS and thus centralizing the centralizer body within the casing string. Once the arms 50 and 60 move to the centralized position as shown in FIG. 1, the centralizer 10, the motor M, and bit B may be further lowered within the casing string CS to a position for engaging the whipstock W, with the arms slidably engaging the casing string as a tubular T is further lowered in the well.

FIG. 2 depicts the centralizer 10 in its retracted position, with the retaining sleeve 70 moved downward for engagement with the lower sub 82 which interconnects the centralizer with the motor M. By lowering the retaining sleeve 70, the biasing force of the compression spring 40 is at least substantially reduced and is preferably eliminated, thereby lowering the arm support sleeve 30 and retracting the arms 50 and 60 so that they are substantially parallel with the axis of the casing string CS. When in the retracted position, the arms 50, 60 do riot extend radially beyond the outer diameter of the upper sub 80 of the centralizer. Accordingly, the retracted centralizer 10 cooperates with the motor M and the bit B to mill the window and/or drill a lateral wellbore without interference from an activated centralizer. Thereafter, the centralizer 10 may be retrieved to the surface through the small diameter tubing string TS.

Figure 3:
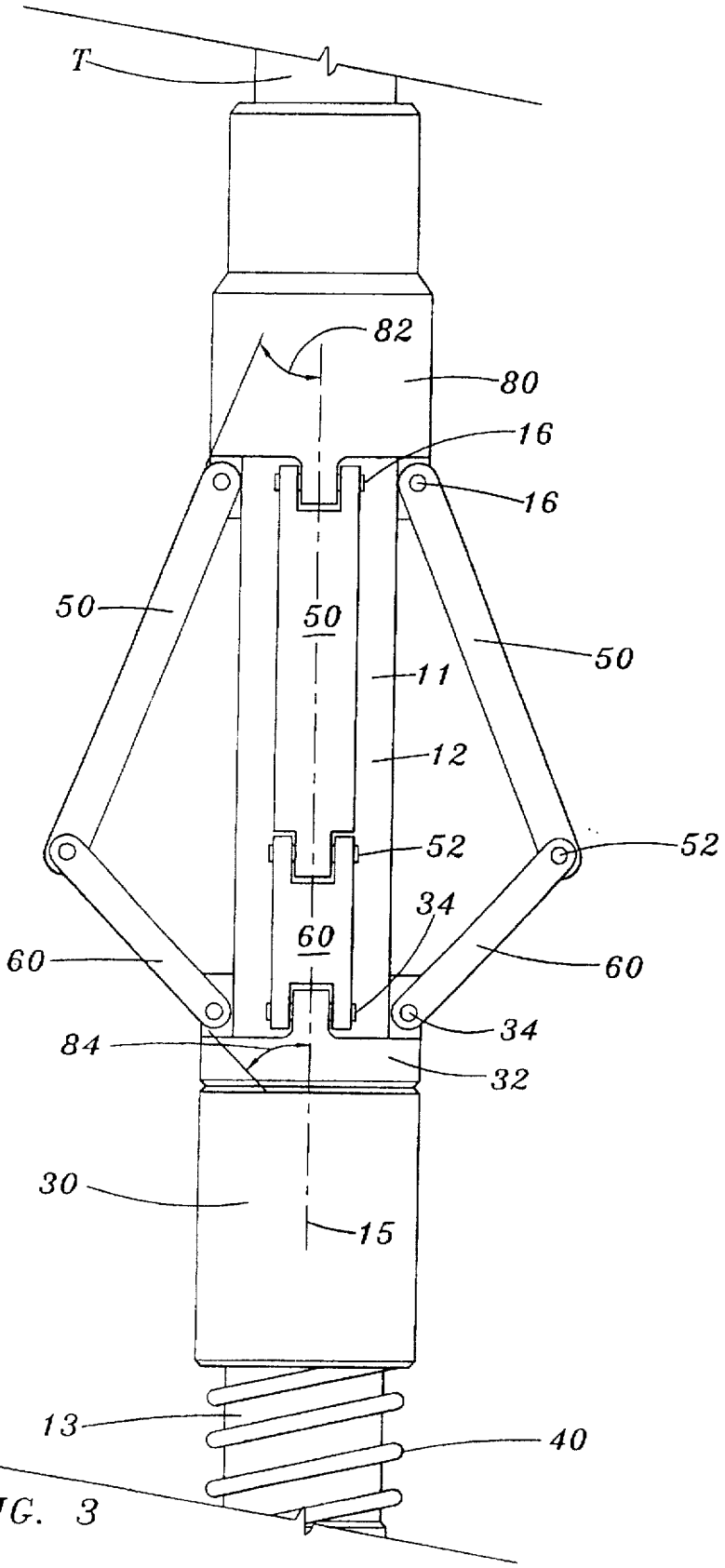
FIG. 3 is a pictorial view of the upper portion of the centralizer generally shown in FIG. 1 in its set position with the centralizer arms expanded radially for engaging the casing string and centralizing the tubular and the bit below the drill motor within the casing string.

FIG. 3 illustrates in greater detail the components within the upper portion of centralizer 10, and particularly the arms 50 and 60. The tubular-shaped centralizer body 12 includes an upper arm support body 11 and a lower spring body 13. The body 12 includes a central throughbore 14 (see FIG. 4) far transmitting fluid to the motor M, and the body 12 is generally centrally positioned about centralizer axis 15 which passes through the throughbore. Each of the upper arms 50 are pivotally connected at their uppermost ends to ears 90 extending downward from sub 80 and thus secured to the arm support body 11. The lower end of the arm support body 1 is threadedly connected at 17 (see FIG. 4) to the spring body 13. A tubular-shaped cylinder 18 is threaded at 19 to the spring body 13. The lower end of the cylinder 18 is threadedly connected to the lower sub 82 by threads 84. Both the upper sub 80 and the lower sub 82 include threaded ends for conventional engagement with the tubular T and the motor M, respectively. As suggested by FIG. 3, four upper and lower arms spaced at 90° intervals are provided in the disclosed embodiment.

Figure 4:
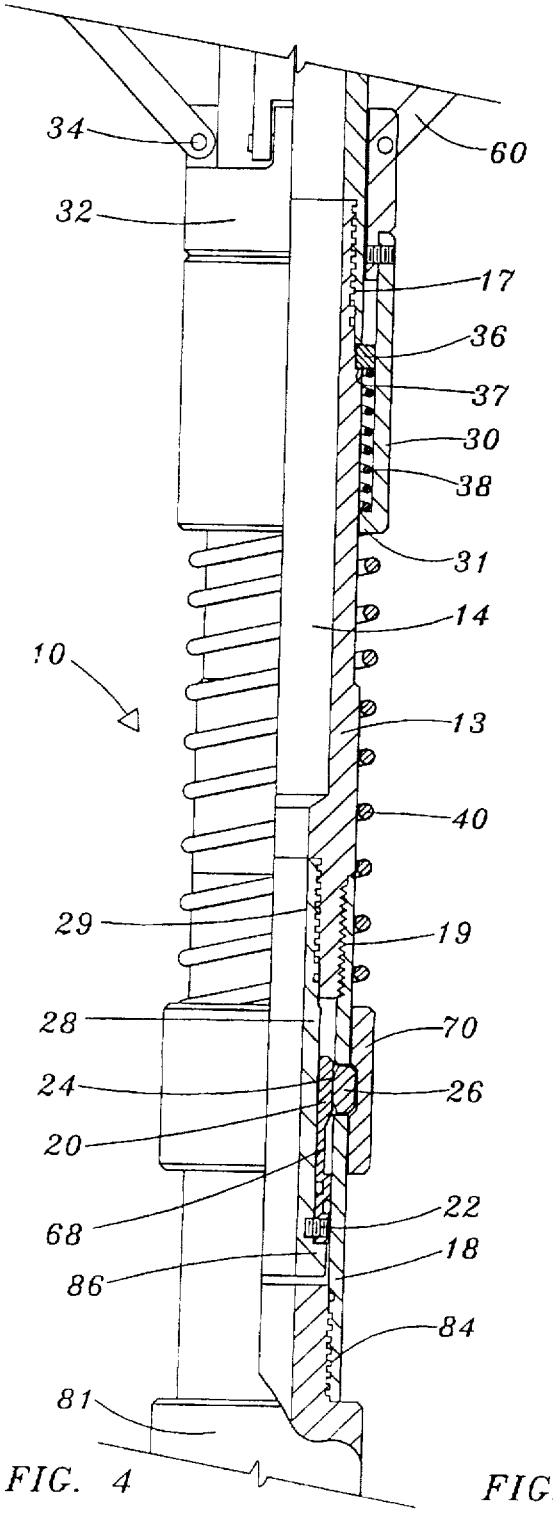
FIG. 4 is an elevational view, partially in cross-section, of the lower portion of the centralizer generally shown in FIG. 1 in its set position.
Figure 5:
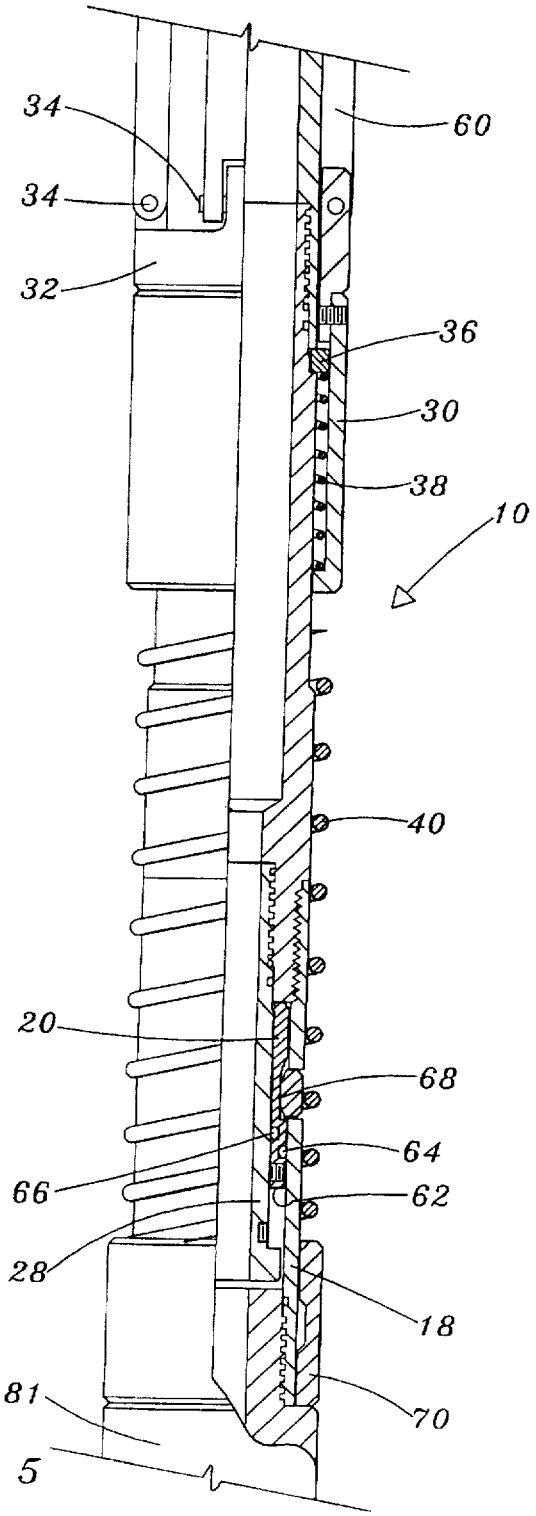
FIG. 5 is an elevational view, partially in cross-section, of the centralizer as shown in FIG. 2 in its released position after increased fluid pressure has been applied and the arms retracted for milling the window and/or drilling the lateral wellbore. The centralizer and other tools suspended from the tubular may then subsequently be retrieved to the surface through the small diameter tubing string.

A tubular-shaped piston 20 is axially moveable within the cylinder 18 from a lower set position, as shown in FIG. 4, to an upper released position, as shown in FIG. 5. Positioned radially inward of the piston 20 is guide sleeve 28, which is threaded at 29 to spring body 13. Shear pin 22 normally extends radially inward from the piston 20 to a groove within sleeve 28, and thus normally retains the piston in its set position. When in the position as shown in FIG. 4, the outer cylindrical surface 24 of the piston serves as a stop surface to prevent radially inward movement of a plurality of circumferentially spaced keys 26. Each key 26 may fit within a respective port provided in the cylinder 18, thereby retaining each key axially and circumferentially in place. Alternatively, the plurality of circumferentially spaced keys may be replaced with one or more split rings such that the ends of the split ring move circumferentially closer together to allow the split ring to move radially inward.

When the piston is retained by the shear pin 22 in its set position, as shown in FIG. 4, a plurality of keys 26 retain the retaining sleeve 70 axially in its set position, as shown in FIG. 4. When the retaining sleeve 70 is in its set position, the sleeve 70 engages the lower surface of coil spring 40, which is positioned about the spring body 13. With the retaining sleeve 70 in the set position, spring 40 is axially compressed, thereby exerting upward biasing force on arm support sleeve 30.

The arm support sleeve 30 is axially moveable from a set position as shown in FIG. 4 to a released position as shown in FIG. 5. When in the set position, the arm support sleeve 30 exerts an upward force on arm support ring 32. Each of the lower arms 60 is pivotally connected to the arm support ring 32 by a pin 34 or other suitable pivot member. Ring 36 is sandwiched in place between the lowermost end of the upper arm sleeve 11 and shoulder 37 provided on the spring sub 13. A release spring 38 is positioned between the ring 36 and the lower flange 31 of the arm support sleeve 30, which extends radially inward in sliding engagement with the spring body 13. Spring 38 thus exerts a downward force on the arm support sleeve, but the downward biasing force of the release spring 38 is significantly less than the upward biasing force of the compression spring 40. Accordingly, the arm support sleeve 30 is maintained in the set position as shown in FIG. 4 as long as the retaining sleeve 70 is retained in its set position.

As previously noted, each of the circumferentially spaced upper arms 50 is pivotally connected an ear 90 which is fixed to the centralizer body 12, and each of the plurality of circumferentially spaced lower arms 60 is similarly pivotally connected to arm support sleeve 30, or to the arm support ring 32 which is interconnected with and functionally part of sleeve 30. Arm support ring 32 may be secured to arm support sleeve 30 by one or more circumferentially spaced pins 33. Alternatively, various other conventional securing members such as threads may be used to interconnect the arm support sleeve 30 with the arm support ring 32. Those skilled in the art will appreciate that the arm support sleeve 30 and the support ring 32 may be provided as a single integral component, although the present design is preferred to reduce the cost of manufacturing the centralizer.

The lower end of each upper arm 50 and the upper end of each lower arm 60 are pivotally connected by a common arm pin 52. When the arm support sleeve 30 is in its set position, each of the upper arms 50 and lower arms 60 thus are substantially angled or inclined with respect to the central axis 15 of the centralizer body. The lower end of each upper arm 50 and/or an upper end of each lower arm 60 is thus positioned radially outwardly substantially from the body 12 and engages the inner surface of the casing string CS, as shown in FIG. 1. It should be understood that, by properly sizing the compression spring 40 and the arm support sleeve 30 and the length of the upper arms 50 and the lower arms 60, the arms of a centralizer may extend outward substantially further than the position as shown in FIG. 3, and accordingly the centralizer is able to centralize a tubular after passing through either a smaller tubing string TS than the exemplary embodiment discussed above, and/or may centralize a tubular within a larger diameter casing string CS than the exemplary embodiment discussed above.

Referring now to FIG. 5, components of a centralizer 10 are shown in their released or retracted position. Movement of centralizer components to the FIG. 5 position is initiated by increasing the fluid pressure in the throughbore 14 of the body 12. Fluid pressure in the throughbore 14 acts on the lower surface 62 of the piston 20, since the outer diameter of the piston 20 is sealed to the cylinder 18 by 0-ring seal 64, and the inner diameter of the piston 20 is similarly sealed to the sleeve 28 by the o-ring 66. Increased fluid pressure in the throughbore 14 passes downward past the sleeve 28, and around the lower end of the sleeve 28 to exert an upward force on the piston 20. Shear pin 22 is reliably sheared at a predetermined force, and thus a predetermined high fluid pressure within the throughbore 14 will shear the pin 22, thereby releasing the piston 20 from its set position and allowing fluid pressure to move the piston upward to its released position, as shown in FIG. 5. This upward movement of the piston 20 allows the plurality of keys 215 to move radially inward into the recess 68 which is now positioned axially at the level of the keys 26. Radially inward movement of the keys 26 releases the stopping force on the retaining sleeve 70, so that the downward biasing force of the compression spring 40 now acts on the retaining sleeve 70 to move the retaining sleeve 70 downward to engage the lower sub 82 secured to the centralizer body.

The downward movement of the retaining sleeve 70 also allows the spring 40 to move downward to release the substantially upward biasing force of the compression spring 40 on the arm support sleeve 30. With this upward biasing force removed, the release spring 38 provides a sufficient downward biasing force (in addition to gravity), thereby causing the arm support sleeve 30 to move to its released position, as shown in FIG. 5.

Moving the arm support sleeve 30 downward to its released position pulls the plurality of upper arms 50 and the plurality of lower arms 60 radially inward to a retracted position, as shown in FIG. 5, such that each of the upper and lower arms be substantially parallel to the central axis 15 of the body 12. When in this released position, the upper and lower arms do not extend radially outward beyond the sub 80, and accordingly the centralizer as shown in FIG. 5 will be deactivated so as not to interfere with milling and/or lateral drilling operations. Thereafter, the centralizer may be withdrawn through the small diameter tubing string TS.

It is a feature of the present invention that each of the plurality of upper arms 50 is axially significantly longer than each of a plurality of lower arms 60. Preferably, each upper arm 50 is at least one and a half times the axial length its interconnected lower arm 60 so that, when the centralizer is set in a casing string CS, the angle 82 between the centerline 15 and exterior surface of arm 50 (see FIG. 3) is less than the angle 84 between the centerline 15 and outer surface of the arm 60. As the axial length of the arm 50 increases with respect to the axial length of arm 60, the angle 82 will become lower. A low angle 82 is desired as a precaution to assist in retrieval of the centralizer 10 in the event that, for some reason, the arm support sleeve 30 does not move from its set position as shown in FIG. 4 to its retracted position as shown in FIG. 5. While it is not anticipated that the arm support sleeve 30 cannot be lowered to its retracted position as shown in FIG. 5, it is possible that the sleeve 30 will inadvertently be retained in its set position. This could be due, for example, to the inability to increase pressure sufficiently within the throughbore 14 to shear the pin 22, or to the failure of the piston 20 to move upward in response to increased fluid pressure. It is also possible that, for some reason, key 26 does not move radially inward, or that radially inward movement of the key does not release the sleeve 70, or that the arm support sleeve 30 becomes temporarily seized to the spring body 13.

If the arm support sleeve 30 does not move to its released position, the tubular T and the centralizer 10 may be withdrawn from the well with the arms 50 and 60 being maintained in engagement with the casing string CS until upper arms 50 engage the lowermost end of the tubing string TS. At this point, an upward force may be applied at the surface to the tubular T, so that the lowermost end of the tubing string TS moves the arms 50 radially inward in response to this axially upward pull. By maintaining a low angle 82, the desired camming action on the upper arms increases the radially inward force which tends to move the arms 50 inward and thus force the arm support sleeve 30 downward. By providing a low angle 82, a reasonable upward pull on the tubing T will thus force the arms 50 and 60 inward and will, if necessary, further compress the compression spring 40 in the event that the retaining sleeve 70 has not moved to its released position. Accordingly, centralizer 10 is designed so that it may be retracted from the casing string through the tubing string even if the normal mechanism for retracting the arms as shown in FIGS. 4 and 5 inadvertently fails.

It is also a feature of the invention that increased fluid pressure need not be directly used to overcome the force of the compression spring 40 when in its set position so that the arm support sleeve 30 may be moved to its released position, thereby retracting the arms 50 and 60. Instead of utilizing fluid pressure to overcome the biasing force of compression spring 40, fluid pressure is used to axially move a piston, which then causes the release of a retaining sleeve which supports the compression spring 40. By removing the support from the lower end of the coil spring 40, the biasing force of the spring 40 is eliminated or substantially reduced, thereby allowing the arm support sleeve to move downward. Accordingly, the force required to move the piston from its set position as shown in FIG. 4 to its released position as shown in FIG. 5 may be significantly less than the biasing force of the coil spring 40 when in its set position. A stronger biasing force may thus easily be supplied by providing a stronger coil spring 40 without substantially changing the fluid pressure required to move the piston 20 to its released position. Similarly, the fluid pressure required to shear the pin 22 and release the piston may be easily adjusted by changing out the shear pin without affecting the biasing force of the compression spring 40.

It is a further feature of the invention that the set position of the piston 40 is a lower position, so that the piston is moved axially upward from its set position to its released position. As shown in FIG. 4, the lower surface of the piston 20 may be supported while in its set position on piston support 86, which extends radially outward from the sleeve 28. This feature ensures that, in the event that the centralizer 10 is jarred within either the tubing string TS or the casing string CS, this jarring action does not inadvertently result in axial movement of the piston to its released position. A small annular gap between the outer surface of the piston support 86 and the inner surface of the cylinder 18 is sufficient to supply fluid pressure to the lower end of the piston 20. Alternatively, one or more circumferentially spaced grooves may be provided in the piston support 86 for ensuring that the fluid pressure is applied to the lowermost end 62 of the piston 20 to exert a sufficient force on the piston 20 to shear the pin 22 and raise the piston to its upward released position, as shown in FIG. 5. After the centralizing operation is complete and the operator has completed cutting the window or drilling the lateral with the rotating bit B, fluid pressure to the motor M may be terminated. The centralizer 10 will remain in its retracted position while the operator retrieves the centralizer and the tools suspended therefrom as shown in FIG. 2 to the surface through the tubing string TS.

It is desirable to provide a retract or release spring 38 for exerting a downward biasing force upon the arm support sleeve 30 once the upward force of the compression spring 40 has been moved, thereby moving the arm support sleeve 30 to its retracted position as shown in FIG. 5 and retracting the arms 50 and 60. The release spring may not be necessary in many applications wherein the centralizer is set in a portion of the well which is not highly inclined or horizontal, however, since gravity may be sufficient to lower the arm support sleeve 30 from its set position as shown in FIG. 3 to its released position as shown in FIG. 5 once the biasing force of the compression spring 40 has been moved. Once the biasing force of compression spring 40 is removed, if gravity is insufficient to lower the arm support sleeve to its released position, a slight upward pull on the tubular T once the upper arms 50 engage the lowermost end of the tubing string TS would normally be sufficient to move the arms to their retracted position, as explained above, when the centralizer engages the lowermost end of the tubing string TS.

Various other mechanisms may be utilized for resulting in movement of the arm support sleeve from its set position to a released position in response to axial movement of the piston from its set position to its released position. If the piston 20 is designed for movement axially away from the arms to its released position, an extension movable axially with the piston could support the compression spring, so that the release of the piston eliminates or at least substantially reduces the force on the compression spring, thereby allowing the arm support sleeve to move to its released position. In other embodiments, the piston, the retaining sleeve and the arm support sleeve may each be provided axially above the arms 50 and 60, so that the tool was substantially inverted from the arrangement as shown in FIGS. 3–5. In this inverted embodiment, it would still be desirable to have the piston move upward from its set position to its released position in response to fluid pressure, so that any jarring of the centralizer did not inadvertently release the tool and retract the arms, as previously explained. If the tool is inverted, the plurality of upper arms which would be pivotally connected to the arm support sleeve 30 would preferably still be axially longer than the plurality of lower arms, which would be pivotally secured to the lower end of the body, so that a low angle is provided between the central axis of the centralizer and the outer surface of the upper arms for engaging the lowermost end of the tubing string TS in the event that the tool inadvertently cannot be released in its intended manner.

Figure 6:
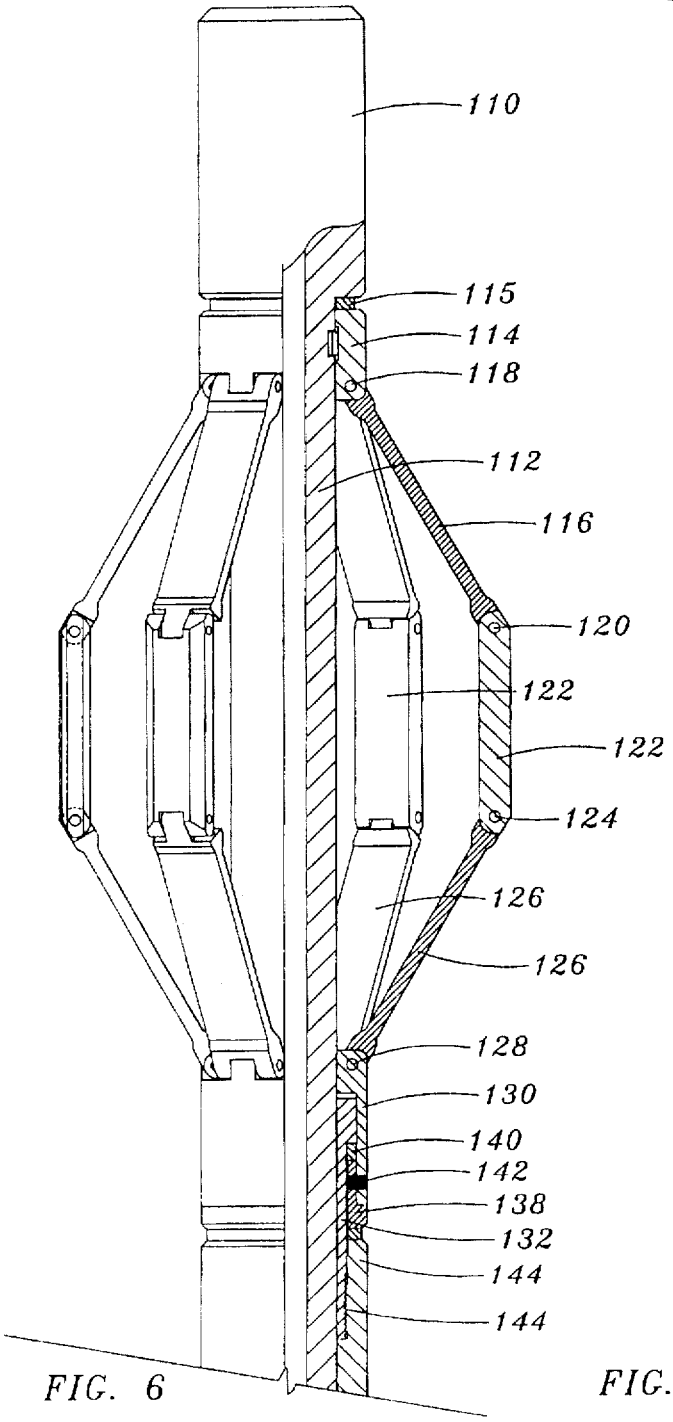
Figure 7:
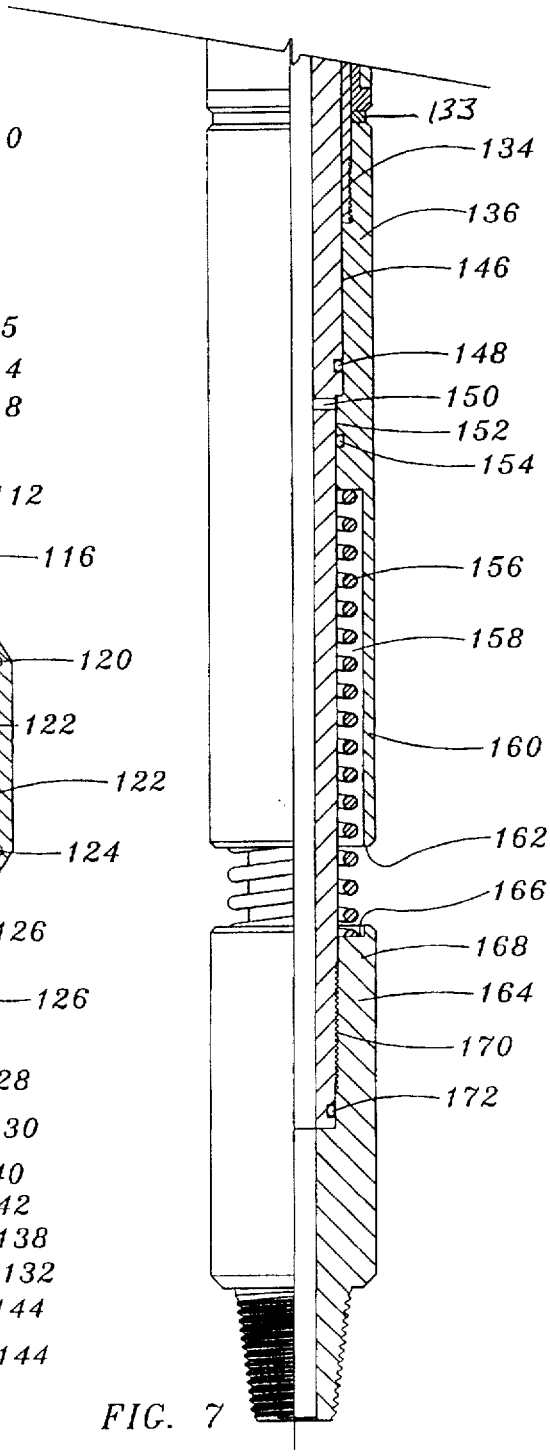

FIGS. 6 and 7 illustrate the upper and lower portions, respectively, of an alternate embodiment of a centralizer 102 according to the present invention. The upper sub 110 corresponds to sub 80 previously discussed, and includes threads or similar interconnection members for securing the sub 110 to tubular T. Upper arm support ring 114 is keyed or otherwise rotationally fixed to the sleeve-shaped body 112 of the centralizer. The wear pad 115 is sandwiched between the sub 110 and the upper ring 114. A plurality of circumferentially spaced upper arms 116 are pivotally connected at 118 to ring 114, which may be formed from a bearing-type material. A plurality of lower arms 126 are similarly pivotally connected at 128 to lower arm support ring 130. A plurality of intermediate rings or pads 122 are pivotally connected at 120 to the lower end of a respective upper arm 116, and are pivotally connected at 124 to an upper end of a respective lower arm 126. A radially outward exterior curved planar surface of the pads 122 thus engage the I.D. of the casing string when the centralizer 102 is in its set position, as shown in FIGS. 6 and 7.

Arm support ring 130 is axially secured to ring 138 by a pin or alien bolt 142. The cylindrical shaped inner diameter of sleeve 132 slides axially with respect to the outer surface of the body 112, as described below. The lower end of the sleeve 132 is interconnected with spring body 136 by threads 144. Bearing 140 is provided between the arm support ring 130 and the sleeve 132. Another wear pad 133 may be provided between ring 138 and spring body 136.

FIG. 7 illustrates spring body 136 with lower end 160 providing a fluidly exposed cavity 158 for at least partially housing coil spring 156 spaced radially about centralizer body 112. Port 150 is provided in centralizer body 112 for allowing fluid pressure to reach the interior surface of the spring body 136. Seal 148 housed on the centralizer body 112 provides a dynamic seal between the centralizer body 112 and the spring body 136, while seal 154 housed on the spring body 136 provides a similar dynamic seal between the spring body and the centralizer body 112. The lower end of the coil spring 156 is supported on the lower sub 168, and preferably fits within an annular cavity 166 at the upper end of the lower sub 168. Spring body 112 is structurally interconnected with the lower sub 168 by threads 170. A static seal 172 provides for sealing engagement between the centralizer body 112 and the lower sub 168. The lower end of sub 168 includes pin threads 164 for structural interconnection with corresponding threads on a lower por-ion of the tubular T below the centralizer 112, or with a sub which structurally interconnects the centralizer 102 with a lower tubular.

For this embodiment as shown in FIGS. 6 and 7, the spring body 136 thus effectively acts as a piston which moves axially against the force of a spring to axially move the arm support sleeve to a retracted position. During reciprocation of the spring body 136, seal 148 continually seals with the internal cylindrical surface 146 of the spring body 136, while seal 154 continually seals with the external cylindrical surface 153 of the centralizer body 112. The difference in the effective seal diameters of seals 148 and 154 creates the piston effects to reciprocate the spring body.

When no fluid pressure or low fluid pressure is being transmitted through the bore of the tubular T and thus through the bore in the centralizer body 112, the difference in the effective diameters of the 0-ring seals 148 and 154 is insufficient to move the spring sub 136 downward with respect to the centralizer body 112, and accordingly the centralizer 102 remains substantially in the position as shown in FIGS. 6 and 7. If fluid pressure to the centralizer 102 is increased, however, the increased fluid pressure passes through the port 150 and creates an axial force (due to the effective sealing diameter difference between the seals 148 and 154) which strokes the spring sub 136 downward, compressing the spring 156. This increased fluid pressure required to axially move the spring sub 136 may be easily controlled by varying the effective sealing diameter difference between the seals 148 and 154, and/or by varying the biasing force of the coil spring 156. In an exemplary application, fluid pressure required to move the spring body 136 downward relative to the centralizer body 112 will be less than the fluid pressure required to activate the downhole motor M, as shown in FIG. 1, which rotates the bit B.

The increased fluid pressure thus strokes the spring sub 136 downward, until the lower surface 162 of the spring sub 136 engages the upper surface of the lower sub 168. When the spring sub 136 is stroked downward in response to fluid pressure, the lower arm support ring 130 is moved downward, thereby lengthening the axial spacing between the pivot points 118 and 128, and thereby effectively retracting the plurality of upper arms 116, the plurality of lower arms 126, and the intermediate links or pads 122 to a position such that the outer surface of each of these components does not extend radially beyond an outer surface of the sub 110.

An advantage of the centralizer 102 as shown in FIGS. 6 and 7 is that the centralizer may be repeatedly moved to a retracted position by simply supplying a high fluid pressure to the centralizer. Each time no or low fluid pressure is supplied to the centralizer, the biasing force of the spring 156 retlins the plurality of upper arms and plurality of lower arms in an expanded position When "normal" or high fluid pressure is supplied to the centralizer at a level sufficient to activate a drill motor, the upper and lower centralizer arms are retracted so that the centralizer does not interfere with window milling or lateral wellbore drilling operations.

Those skilled in the art will appreciate that the links or pads 122 between the plurality of upper arms and the plurality of lower arms are not essential, and instead the lower ends of the upper arms and the upper end of the lower arms may be pivotally connected as shown in FIG. 3 for the embodiment as described in FIGS. 6 and 7. Alternatively, the intermediate links or pads 122 as shown in FIGS. 6 and 7 may also be used in the previously described embodimerts. Conceptually, each of the links or pads 122 may be considered to the lower end of an upper arm or the upper end of a lower arm. In any event, at least one of the lower end of the upper arms and the upper end of the lower arms engages the casing string to centralize the tubular when the centralizer is in its expanded position.

In each of the embodiments discussed above, increased fluid pressure is utilized to move the tool from its run-in or a set position to its released or de-activated position, so as not to interfere with subsequent milling and drilling operations. No or low fluid pressure to the centralizer thus results in the arms expanding to centralize the tool, while normal or high pressure deactivates the arms to a retracted position. Once deactivated, the centralizer tool may also be retracted through the tubing string. In still other embodiments, fluid pressure may be used to directly move a piston upward against a spring to exert an upward force on an arm support sleeve, thereby positioning the arm support sleeve in a set position and inclining the arms 50 and 60 outward for centralizing the tool within the well. The release of fluid pressure to the piston may then allow gravity to move the arm support sleeve downward and retract the arms 50 and 60. Alternatively, the lowermost end of the tubular string TS may be used, as previously described, to move the arms radially inward once the centralizer engages the lowermost end of the tubing string, thereby allowing the retrieval of the centralizer through Ihe tubing string. In still other embodiments, a piston acts against a spring in response to normal or high fluid pressure to the centralizer to move an arm support sleeve to a retracted position. The release of normal or high fluid pressure to the centralizer returns the arm support sleeve to an expanded position in response to the biasing force of the spring.

It should also be noted that for the embodiments as shown in FIGS. 1-5, each of a plurality of upper arms 50 and each of the plurality of lower arms 60 is rotationally fixed relative to the centralizer body. Since the upper arms and lower arms are pivotally connected, it should be understood that by pivotally connecting either of the upper arms or the lower arms to the centralizer body, both the upper arms and lower arms are rotationally fixed relative to the centralizer body. For many types of centralizers, the components which move radially outward to engage the interior wall of the casing are rotatable relative to the centralizer body, as with the embodiment shown in FIGS. 6 and 7. This feature thus allows centralizer pads to engage the I.D. of the casing so that the centralizer body structurally connected to the tubing string may rotate relative to the stationary pads. For the embodiments as shown in FIGS. 1-5, the arms 50, 60 which expand radially outward to engage the casing string CS are rotationally fixed relative to the centralizer body. It is not thus necessary according to these embodiments to allow the arms to rotate relative to the centralizer body since the centralizer body need not rotate while the centralizer is activated and the arms are positioned radially outward. For the application shown in FIGS. 1 and 2 wherein the centralizer acts to centralize a bit B relative to a whipstock W, expanded centralizer arms slidably engage the casing string CS as the centralizer is moved downward within the casing string. A motor WI below the centralizer 10 rotates the bit, and accordingly tubular T on which the centralizer 10 is positioned does not rotate when the centralizer is performing its centralizing function. Once fluid pressure to the motor M increases to a level sufficient to power the bit B for its cutting operation, the centralizer 10 is deactivated so that the arms are returned radially inward against the centralizer body so that the centralizer 10 does not interfere with window milling or lateral wellbore drilling operations. As previously noted, the tubular on which the centralizer is positioned may be coiled tubing, which normally is not rotated in a well.

Based on the above disclosure, those skilled in the art will appreciate that the centralizer of the present invention has utility in various application for desirably positioning the axis of the tubular or a tool positioned along a tubular within a casing string, and that the exemplary application described herein for centrally positioning the tubular and thus a motor and bit with respect to a whipstock are generally illustrative of a suitable application. The centralizer of the present invention may be used for positioning various types of tubulars centrally within a casing string for engagement, disengagement or cooperation with various types of downhole tools. The centralizer may also be utilized to centrally position a tubular or a tool along a tubular within a open hole which does not include a casing string. Although particularly well suited for use in thru-tubing applications where the centralizer is first passed through a tubing string then set in a casing string, the centralizer also has utility for centralizing a tubular within a casing string wherein the tubular and the centralizer are not passed through or retrieved to the surface through a tubing string.

In all the embodiments discussed above, the centralizer is utilized to align the axis of the tubular along which the centralizer is positioned with respect to the axis of the casing string (or with the central axis of the open hole). With minor modifications, however, the tool of the present invention may be utilized to desirably position the axis of a tubular at an offset position with respect to the axis of the casing string or the axis of an open hole. Such an application may be desired, for example, to interconnect a tubular with one of dual lower tubulars positioned within a casing string. For these embodiments wherein the tool 5 used to position the axis of the tubular at desired offset with respect to the axis of the casing string, a plurality of circumferentially spaced upper and lower arms may be provided about the body of the tool, as explained herein, but the effective axial pivot length of one or more of the upper arms or one of more of the lower arms may be varied compared to the axial length of other of the upper arms or corresponding lower arms.

By way of an example, if three upper arms and three lower arms are each circumferentially spaced that 120° about the body, with Arm Combination 1 being at the 12:00 position, Arm Combination 2 being at the 4:00 position, and Arm Combination 3 being at the 8:00 position, an axially shorter combination of the upper and lower arms for Arm Combination I will cause the set tool to be diverted from the axis of the casing string toward the 12:00 position. The engagement of Arm Combination 2 and Arm Combination 3 with the casing string wall will thus divert the tool toward the 12:00 position, and the amount of radilal diversion can effectively be controlled by regulating the axial length of Arm Combination I with respect to the axial length of both Arm Combinations 2 and 3.

The foregoing disclosure and description of the centralizer is illustrative and explanatory thereof. It will be appreciated by those skilled in the art that various changes in the size, shape and materials, as well as in the details of the illustrated construction or combinations of features of the centralizer may be made without departing from the spirit of the invention, which is defined by the claims.

What is claimed is:

1. A centralizer positioned along a tubular for centralizing the tubular within a casing string, the centralizer comprising:

a centralizer body having a throughbore for transmitting fluid through the centralizer, the centralizer body having a central axis within the throughbore;

a piston axially movable in response to increased fluid pressure within the throughbore from a set position to a released position;

an arm support sleeve axially movable relative to the centralizer body between a set position and a released position in response to axial movement of the piston;

a compression spring for biasing the arm support sleeve to the set position while allowing axial movement of the arm support sleeve relative to the centralizer body to alter the effective diameter of the centralizer when the arm support sleeve is in the set position;

a plurality of circumferentially spaced upper arms each pivotally connected at an upper end to one of the centralizer body and the axially movable arm support sleeve; and a corresponding plurality of circumferentially spaced lower arms each pivotably connected at a lower end to the other of the centralizer body and the arm support sleeve and pivotally connected at an upper end to a lower end of a corresponding one of the plurality of upper arms, such that the plurality of upper arms and the plurality of lower arms are movable between the set position wherein at least one of the lower ends of the upper arms and the upper ends of the lower arms engage the casing string to centralize the tubular and a released position wherein the upper arms and the lower arms radially retract with respect to the centralizer body.

2. The centralizer as defined in claim 1, further comprising:

a retaining sleeve for axially positioning the compression spring, the retaining sleeve being axially movable from a set position to a released position in response to axial movement of the piston, such that the biasing force of the compression spring on the arm support sleeve is at least substantially reduced when the retaining sleeve is moved to the released position.

3. The centralizer as defined in claim 2, wherein the piston includes a stop surface to prevent movement of the retaining sleeve to the released position until the piston has moved to the released position.

4. The centralizer as defined in claim 1, further comprising:

a shear pin interconnecting the piston to the centralizer body to retain the piston in the set position, such that increased fluid pressure in the throughbore shears the pin to release the piston to the released position.

5. The centralizer as defined in claim 1, further comprising:

a retract spring for acting on at least one of the plurality of upper arms and the plurality of lower arms for retracting both the plurality of upper arms and the plurality of lower arms when the piston is moved to the released position.

6. The centralizer as defined in claim 1, wherein each of the plurality of upper arms and the plurality of lower arms is rotationally fixed to the centralizer body.

7. The centralizer as defined in claim 1, wherein the plurality of upper arms each having an axial length greater than an axial length of each of the plurality of lower arms.

8. The centralizer as defined in claim 7, wherein the axial length of each of the plurality of upper arms is at least 1.5 times the axial length of each of the plurality of lower arms.

9. A retrievable thru-tubing centralizer securable to a tubular for passing through a small diameter tubing string in a wellbore and for centralizing the tubular within a large diameter casing string at a position below a lower end of the tubing string, the centralizer comprising:

a centralizer body having a throughbore for transmitting fluid through the centralizer, the centralizer body having a central axis within the throughbore;

a piston axially movable in response to fluid pressure within the throughbore from a set position to a released position;

an arm support sleeve axially movable relative to the centralizer body between a set position and a released position in response to axial movement of the piston;

a compression spring for biasing the arm support sleeve to the set position;

a plurality of circumferentially spaced upper arms each pivotally connected at an upper end to one of the centralizer body and the axially movable arm support sleeve; and a corre sponding plurality of circumferentially spaced lower arms each pivotably connected at a lower end to the other of the centralizer body and the arm support sleeve and pivotally connected at an upper end to a lower end of a corresponding one of the plurality of upper arms, such that the plurality of upper arms and the plurality of lower arms are movable from a set position wherein the arms are substantially inclined relative to the central axis of the centralizer body for engaging the casing string to centralize the tubular to a released position wherein the arms retract to pass through the tubing string; and a retract spring for acting on at least one of the plurality of upper arms and the plurality of lower arms for retracting both the plurality of upper arms and the plurality of lower arms when the piston is moved to the released position.

10. The retrievable thru-tubing centralizer as defined in claim 9, wher ein the plurality of upper arms each having an axial length at least 1.5 times an axial length of each of the plurality of lower arms.

11. The thru-tubing centralizer as defined in claim 9, further comprising:

a retaining sleeve for axially positioning the compression spring, the retaining sleeve being axially movable from a set position to a released position in response to axial movement of the piston, such that the biasing force of the set biasing spring on the arm support sleeve is at least substantially reduced when the retaining sleeve is moved to the released position; and the piston includes a stop surface to prevent movement of the retaining sleeve to the released position until the piston has moved to the released position.

12. The thru-tubing cen tralizer as defined in claim 9, further comprising:

a shear pin interconnecting the piston to the centralizer body to retain the piston in the set position, such that increased fluid pressure in the throughbore shears the pin to release the piston to the released position.

13. The thru-tubing centralizer as defined in claim 9, wherein:

the plurality of upper arms and the plurality of lower arms comprises at least three circumferentially spaced upper arms and three circumferentially spaced lower arms; and each of the plurality of upper arms is rotationally fixed relative to the centralizer body.

14. The thru-tubing centralizer as defined in claim 9, wherein:

the lower end of each of the plurality of lower arms is pivotally connected to the arm support sleeve; and the piston is an annular member which moves axially upward toward the arm support sleeve from the set position to the released position.

15. A method of centralizing a tubular within a large diameter casing string after passing the tubular through a small diameter tubing string and past a lower end of the small diameter tubing string, the method comprising:

securing a centralizer body along the tubular, the centralizer body having a throughbore for transmitting fluid through the centralizer body and having a central axis within the throughbore;

providing a piston axially movable with respect to the centralizer body from a set position to a released position;

providing an arm support sleeve axially movable relative to the centralizer body from a set position to a released position in response to axial movement of the piston;

pivotably connecting each of a plurality of circumferentially spaced upper arms at an upper end to one of the centralizer body and the axially movable arm support sleeve;

pivotably connecting each of a corresponding plurality of circumferentially spaced lower arms at a lower end to the other of the centralizer body and the arm support sleeve;

pivotably connecting an upper end of each of the plurality of lower arms to a lower end of a corresponding one of the plurality of upper arms; adjusting an axial position of the arm support sleeve relative to the centralizer body to alter the effective diameter of the centralizer when the arm support sleeve is in the set position: and with the centralizer body positioned below the lower end of the small diameter tubing string and at a selected axial position within the large diameter casing string, increasing fluid pressure within the throughbore to move the piston from the set positioned to the released position and thereby move the arm support sleeve axially from the set position to the released position, such that the plurality of upper arms and the plurality of lower arms move from a set position wherein the arms engage the casing string to centralize the tubular to a released position wherein the arms retract to disengage the casing string.

16. The method as defined in claim 15, further comprising:

biasing the arm support sleeve to the set position; and at least substantially reducing the biasing force on the arm support sleeve when the piston is moved to the released position.

17. The method as defined in claim 15, further comprising:

the plurality of upper arms each having an axial length greater than an axial length of each of the plurality of lower arms;

engaging the plurality of upper arms with the lower end of the small diameter tubing string to move the plurality of arms to a retracted position; and retrieving the centralizer body and the plurality of arms to the surface through the small diameter tubing string.

18. The method as defined in claim 15, further comprising:

biasing at least one of the plurality of upper arms and the plurality of lower arms to a retracted position for retracting both the plurality of upper arms and the plurality of lower arms when the piston is moved to the released position.

19. The method as defined in claim 15, further comprising:

rotationally securing each of the plurality of upper arms to the centralizer body.

20. A centralizer positioned along a tubular for centralizing the tubular within a casing string, the centralizer comprising:

a centralizer body having a throughbore for transmitting fluid through the centralizer, the centralizer body having a central axis within the throughbore;

a piston axially movable in response to increased fluid pressure within the throughbore from a set position to a released position, the piston including a stcp surface thereon;

an arm support sleeve axially movable relative to the centralizer body between a set position and a released position in response to axial movement of the piston;

a compression spring for biasing the arm support sleeve to the set position;

a retaining sleeve axially movable for altering a biasing force of the compression spring, the retaining sleeve being axially movable relative to the arm support sleeve from a set position maintained by the stop surface on the piston when in the set position to a released position in response to axial movement of the piston to the released position, such that the biasing force of the compression spring on the arm support sleeve is at least substantially reduced when the retaining sleeve is moved to the released position;

a plurality of circumferentially spaced upper arms each pivotally connected at an upper end to one of the centralizer body and the axially movable arm support sleeve; and a corresponding plurality of circumferentially spaced lower arms each pivotably connected at a lower end to the other of the centralizer body and the arm support sleeve and pivotally connected at an upper end to a lower end of a corresponding one of the plurality of upper arms, such that the plurality of upper arms and the plurality of lower arms are movable between the set position wherein at least one of the lower ends of the upper arms and the upper ends of the lower arms engage the casing string to centralize the tubular and a released position wherein the upper arms and the lower arms radially retract with respect to the centralizer body.

21. The centralizer as defined in claim 20, further comprising:

a retract spring for acting on at least one of the plurality of upper arms and the plurality of lower arms for retracting both the plurality of upper arms and the plurality of lower arms when the piston is moved to the released position.

22. The centralizer as defined in claim 20, wherein an axial length of each of the plurality of upper arms is at least 1.5 times an axial length of each of the plurality of lower arms.

23. The centralizer as defined in claim 20, further comprising:

a shear pin interconnecting the piston to the centralizer body to retain the piston in the set position, such that increased fluid pressure in the throughbore shears the pin to release the piston to the released position.

24. The centralizer as defined in claim 20, wherein each of the plurality of upper arms and the plurality of lower arms is rotationally fixed to the centralizer body.

* * * * *

UNITED STATES PATENT AND TRADEMARK OFFICE

CERTIFICATE OF CORRECTION

PATENT NO. : 5,758,723
DATED : June 2, 1998
INVENTOR(S) : David Dwayne Saucier and Britt O. Braddick It is certified that error appears in the above-indentified patent and that said Letters Patent is hereby corrected as shown below:

In column 16 line 43, delete the gap"corre sponding" and insert --corresponding--.

In column 16 line 61, delete the gap "wher ein" and insert --wherein--.

In column 17, line 9, delete the gap" cen tralizer and insert --centralizer--.

In column 17, line 56, start a new paragrah with "adjusting".

In column 17, line 59, delete ":" and insert --j--.

Signed and Sealed this

Thirteenth Day of October 1998

*Attest:*

*Attesting Officer*

BRUCE LEHMAN

*Commissioner of Patents and Trademarks*